US010973274B2

(12) United States Patent
Levesque et al.

(10) Patent No.: US 10,973,274 B2
(45) Date of Patent: Apr. 13, 2021

(54) HELMET, MOUNTING SYSTEM FOR A HELMET AND METHOD OF USING SAME

(71) Applicant: KIMPEX INC., Drummondville (CA)

(72) Inventors: Jean-Simon Levesque, Victoriaville (CA); Nicolas Bouchard Fortin, Racine (CA); Étienne Gilbert, Beloeil (CA); Stéphane Dion, Sainte-Cécile de Milton (CA)

(73) Assignee: Kimpex Inc., Quebec (CA)

( * ) Notice: Subject to any disclaimer, the term of this patent is extended or adjusted under 35 U.S.C. 154(b) by 261 days.

(21) Appl. No.: 16/051,041

(22) Filed: Jul. 31, 2018

(65) Prior Publication Data

US 2020/0037692 A1 Feb. 6, 2020

(51) Int. Cl.
*A42B 3/22* (2006.01)
*A42B 3/04* (2006.01)

(52) U.S. Cl.
CPC ..... *A42B 3/223* (2013.01); *A42B 3/227* (2013.01); *A42B 3/0406* (2013.01)

(58) Field of Classification Search
CPC ..... A42B 3/22; A42B 3/227; A42B 3/224; A42B 3/223; A42B 3/221; A42B 3/0406; A42B 3/222; A42B 3/326
USPC ..... 2/6.5, 6.3, 6.4, 424, 15
See application file for complete search history.

(56) References Cited

U.S. PATENT DOCUMENTS 3,066,305 A * 12/1962 Aileo ..... A42B 3/228 2/431
3,636,565 A * 1/1972 Luisada ..... A42B 3/228 2/410
3,727,235 A * 4/1973 Fisher ..... A42B 3/222 2/10
5,062,162 A * 11/1991 Kamata ..... A42B 3/222 2/424
5,333,329 A 8/1994 Hong
5,890,233 A * 4/1999 Kaffka ..... A42B 3/226 2/10
6,260,213 B1 * 7/2001 Eom ..... A42B 3/222 2/424

(Continued)

FOREIGN PATENT DOCUMENTS

CN 106605991 A 5/2017
EP 0826317 B1 11/2003

(Continued)

OTHER PUBLICATIONS

Shoei Co.,Ltd., J-Cruise, Instructions for use, Sep. 2012, 10 pages.
Schuberth, Manual, E1, before Jul. 30, 2018, 165 pages.

*Primary Examiner* — Alissa L Hoey
*Assistant Examiner* — Patrick J. Lynch
(74) *Attorney, Agent, or Firm* — Quarles & Brady LLP

(57) ABSTRACT

A helmet is provided. The helmet includes a helmet shell and a mounting system laterally positioned on the helmet shell. The helmet further includes a visor removably and pivotally connected to the mounting system, the visor being movable between lowered and raised positions. Finally, the helmet includes a peak removably connected to the mounting system, the mounting system being operable to disengage the visor and the peak upon manual operation thereof. A mounting system for customizing a helmet is also provided. Finally, a method of configuring the helmet is provided.

19 Claims, 15 Drawing Sheets

(56) References Cited

U.S. PATENT DOCUMENTS

| | | | | |
|---|---|---|---|---|
| 6,851,129 | B2 | 2/2005 | Gafforio et al. | |
| 8,011,025 | B2 * | 9/2011 | Lee | A42B 3/326 2/424 |
| 9,491,980 | B2 | 11/2016 | Wako | |
| 2006/0117467 | A1 * | 6/2006 | Choi | A42B 3/222 2/424 |
| 2007/0074335 | A1 * | 4/2007 | Gafforio | A42B 3/223 2/410 |
| 2010/0005558 | A1 * | 1/2010 | Lee | A42B 3/223 2/15 |
| 2015/0074877 | A1 * | 3/2015 | Huh | A42B 3/222 2/422 |
| 2017/0112225 | A1 | 4/2017 | Gotti | |
| 2017/0215508 | A1 | 8/2017 | Salvetti et al. | |
| 2017/0215509 | A1 | 8/2017 | Dutour et al. | |
| 2018/0103710 | A1 * | 4/2018 | Kim | A42B 3/326 |

FOREIGN PATENT DOCUMENTS

| | | | | |
|---|---|---|---|---|
| FR | 3079720 | A1 * | 10/2019 | A42B 3/006 |
| JP | H05209303 | A | 8/1993 | |
| TW | 357066 | B | 5/1999 | |
| WO | WO-2007144938 | A1 * | 12/2007 | A42B 3/222 |

* cited by examiner

HELMET, MOUNTING SYSTEM FOR A HELMET AND METHOD OF USING SAME

TECHNICAL FIELD

The technical field generally relates to a protective helmet, and more specifically to a helmet provided with a visor and a peak. A mounting system provided on the helmet is adapted to removably receive the visor and/or peak, and to allow the visor and/or peak to move relative to the helmet.

BACKGROUND

A helmet, such as those used for outdoor activities, typically comprises an external shell defining a cavity for housing a wearer's head, and a front opening to allow the wearer to see. In the case of snowmobile helmets, the front opening is traditionally covered by goggles or a visor pivotally mounted to the helmet shell to protect the eyes of the wearer when riding. Additionally, many models of snowmobile helmets are provided with a peak mounted on the front of the helmet to protect the user from weather-related issues, such as sunlight, rain and debris for example.

On occasions, it may be necessary to clean, remove or replace helmets parts, such as the visor and/or peak.

SUMMARY

According to a first aspect, a helmet is provided. The helmet includes a helmet shell, a mounting system laterally positioned on the helmet shell and a visor removably and pivotally connected to the mounting system. The visor is movable between lowered and raised positions. The helmet also includes a peak removably connected to the mounting system. The mounting system is operable to disengage the visor and the peak upon manual operation thereof.

According to a possible embodiment, the peak is pivotally connected to the mounting system and is movable between lowered and raised positions.

According to a possible embodiment, the mounting system is operable to disengage both the visor and the peak simultaneously.

According to a possible embodiment, the mounting system includes an actuator, and wherein operating the actuator disengages both the visor and the peak.

According to a possible embodiment, the mounting system includes right and left mounting mechanisms positioned on right and left sides of the helmet shell, and wherein the actuator includes right and left pushbuttons operable to disengage the visor and the peak.

According to a possible embodiment, each mounting mechanism includes a base positioned on corresponding right and left sides of the helmet shell, the base of each mounting mechanism having a corresponding actuator. Each mounting mechanism further including a first slider operably connected to the base, the first slider being adapted to selectively engage the visor and the peak, wherein upon operating the actuator, the first slider slides and disengages the visor and/or peak to disconnect the visor and/or peak from the mounting system.

According to a possible embodiment, the visor includes right and left visor mounting sections, and wherein each base includes a visor channel adapted to receive one of said visor mounting sections.

According to a possible embodiment, each visor mounting section includes a visor key path, and each base includes a visor lock overhanging the visor channel, the visor lock being engageable with the visor key path to secure the visor to the mounting system.

According to a possible embodiment, the visor key path disengages from the visor lock upon positioning the visor in the raised position.

According to a possible embodiment, each visor mounting section includes a visor groove, and wherein the first slider includes a visor engaging element engageable within the visor groove, further securing the visor to the mounting system.

According to a possible embodiment, movement of the visor is blocked when the visor engaging element is engaged with the visor groove.

According to a possible embodiment, the peak includes right and left peak mounting sections, and each base includes a peak channel adapted to receive respective peak mounting sections.

According to a possible embodiment, each peak mounting section includes a peak key path, and each base includes a peak lock overhanging corresponding peak channels, the peak locks being engageable with corresponding peak key paths so as to secure the peak to the mounting system.

According to a possible embodiment, the peak key paths are disengaged from the peak locks upon positioning the peak in the raised position.

According to a possible embodiment, each peak mounting section includes a peak groove, and the first slider includes a peak engaging element engageable with the peak groove, further securing the peak to the mounting system.

According to a possible embodiment, the first slider is spring-loaded to bias the peak and/or visor engaging elements in an engaged position.

According to a possible embodiment, the actuator and first slider include complementary surfaces cooperating by having the first slider slide away from the actuator upon operation thereof, thus disengaging the peak and/or visor engaging elements.

According to a possible embodiment, each mounting mechanism further includes a secondary slider having a secondary peak engaging element operably engageable with the peak, the secondary peak engaging element preventing rotation of the peak when engaged therewith.

According to a possible embodiment, the secondary slider is spring-loaded to bias the secondary peak engaging element in an engaged position.

According to a possible embodiment, upon pivoting the peak between the lowered and raised positions, the secondary slider disengages the peak to allow movement thereof.

According to a possible embodiment, each mounting mechanism further includes a biasing element adapted to bias the visor and/or peak away from the helmet shell to facilitate removal of said visor and/or peak.

According to a possible embodiment, the actuator is a pushbutton or a lever mechanism.

According to a second aspect, a mounting system for removably connecting a visor and a peak to a helmet is provided. The mounting system includes right and left mounting mechanisms laterally positioned on the helmet, each mounting mechanism having a base, an actuator positioned on the base and a first slider operably connected to the actuator, the first slider being adapted to selectively engage the visor and the peak, wherein upon operation of the actuator, the first slider disengages the visor and/or peak so as to disconnect same from the helmet.

According to a possible embodiment, the peak and the visor are pivotally connected to the helmet, and are therefore movable between a raised position and a lowered position, respectively.

According to a possible embodiment, the mounting system is further adapted to disengage both the visor and the peak simultaneously.

According to a possible embodiment, the visor includes right and left visor mounting sections, and each base includes a visor channel adapted to receive corresponding visor mounting sections.

According to a possible embodiment, each visor mounting section includes a visor key path, and each base includes a visor lock overhanging corresponding visor channels, the visor locks being engageable with corresponding visor key paths so as to secure the visor on the mounting system.

According to a possible embodiment, the visor key path disengages from the visor lock upon positioning the visor in the raised position.

According to a possible embodiment, each visor mounting section includes a visor groove, and wherein the first slider includes a visor engaging element engageable within the visor groove, further securing the visor to the mounting system.

According to a possible embodiment, movement of the visor is blocked when the visor engaging element is engaged with the visor groove.

According to a possible embodiment, the peak includes right and left peak mounting sections, and each base includes a peak channel adapted to receive respective peak mounting sections.

According to a possible embodiment, each peak mounting section includes a peak key path, and each base includes a peak lock overhanging corresponding peak channels the peak locks being engageable with corresponding peak key paths so as to secure the peak to the mounting system.

According to a possible embodiment, the peak key paths are disengaged from the peak locks upon positioning the peak in the raised position.

According to a possible embodiment, each peak mounting section includes a peak groove, and the first slider includes a peak engaging element engageable with the peak groove, further securing the peak to the mounting system.

According to a possible embodiment, the first slider is spring-loaded to bias the peak and/or visor engaging elements in an engaged position.

According to a possible embodiment, the actuator and first slider include complementary surfaces cooperating by having the first slider slide away from the actuator upon operation thereof.

According to a possible embodiment, each mounting mechanism further includes a secondary slider having a secondary peak engaging element operably engageable with the peak, the secondary peak engaging element preventing rotation of the peak when engaged therewith.

According to a possible embodiment, the secondary slider is spring-loaded to bias the secondary peak engaging element in an engaged position.

According to a possible embodiment, upon pivoting the peak between the lowered and raised positions, the secondary slider disengages the peak to allow movement thereof.

According to a possible embodiment, each mounting mechanism further includes a biasing element adapted to bias the visor and/or peak away from the helmet to facilitate removal of said visor and/or peak.

According to a possible embodiment, the actuator is a pushbutton.

According to a possible embodiment, the actuator is a lever mechanism.

According to a third aspect, a method of configuring a helmet having a visor and a peak being both removably connected thereto via a mounting system is provided. The method including the steps of manually operating the mounting system to disengage at least one of the visor and peak and positioning at least one of the visor and peak in a raised position.

According to a possible embodiment, the method includes positioning both the visor and peak in the raised position and disengaging both the visor and peak from the helmet by manually operating the mounting system.

According to a possible embodiment, manually operating the mounting system includes actuating a lever or a pushbutton to disengage the visor and/or the peak.

According to a possible embodiment, manually operating the mounting system disengages both the visor and the peak simultaneously.

According to a possible embodiment, manually operating the mounting system includes operating left and right mounting mechanisms positioned on the right and left sides of the helmet.

According to a possible embodiment, manually operating the mounting system includes operating left and right mounting sections positioned on the right and left sides of the helmet.

According to a possible embodiment, manually operating the mounting system includes pushing a pushbutton, the pushbutton cooperating with a slider that selectively disengages at least one of the peak and visor from the helmet.

DETAILED DESCRIPTION

Figure 1:
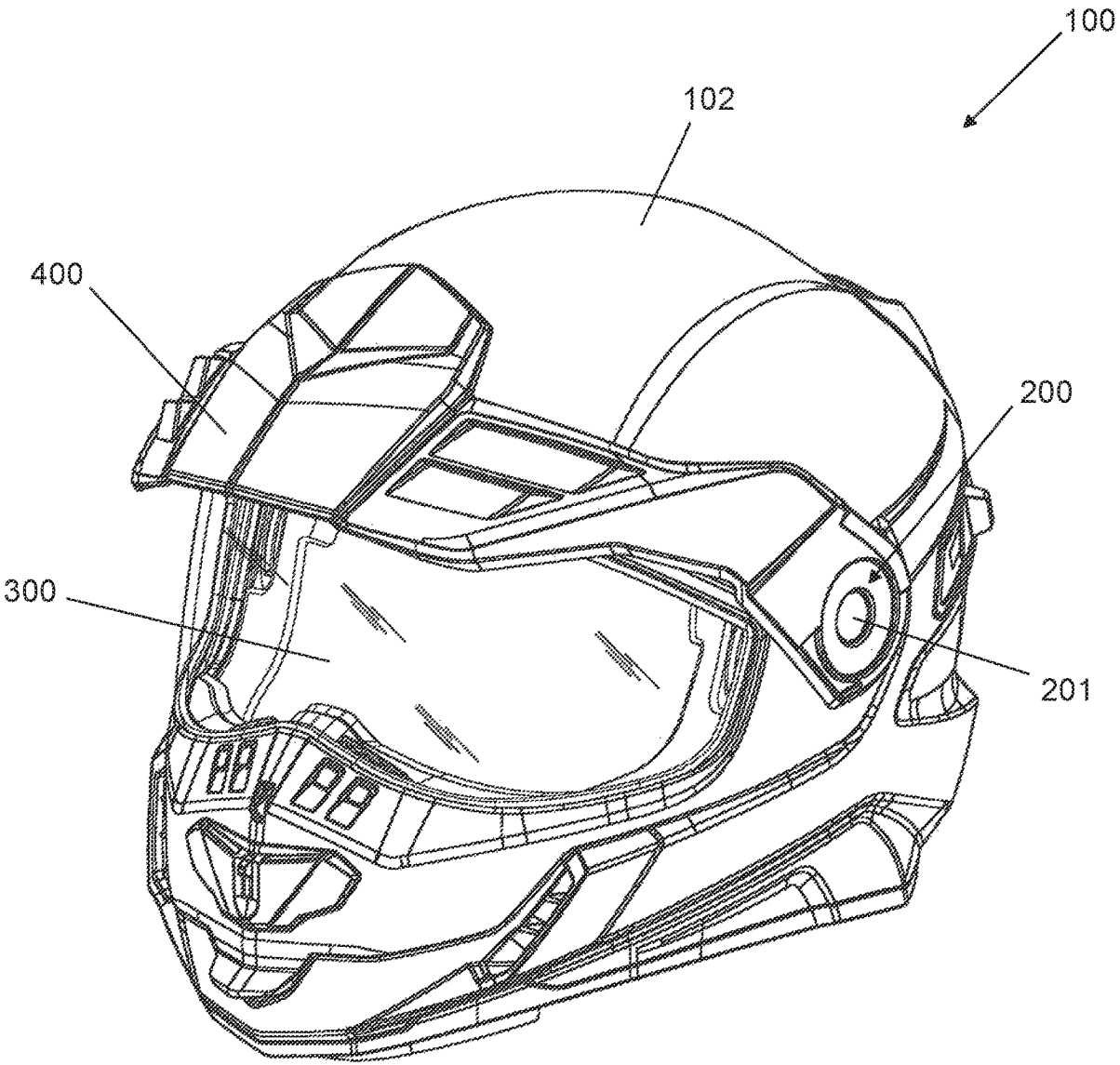
FIG. 1 is a front perspective view of a helmet according to an embodiment, showing a visor and a peak connected to the helmet in a lowered position.
Figure 2:
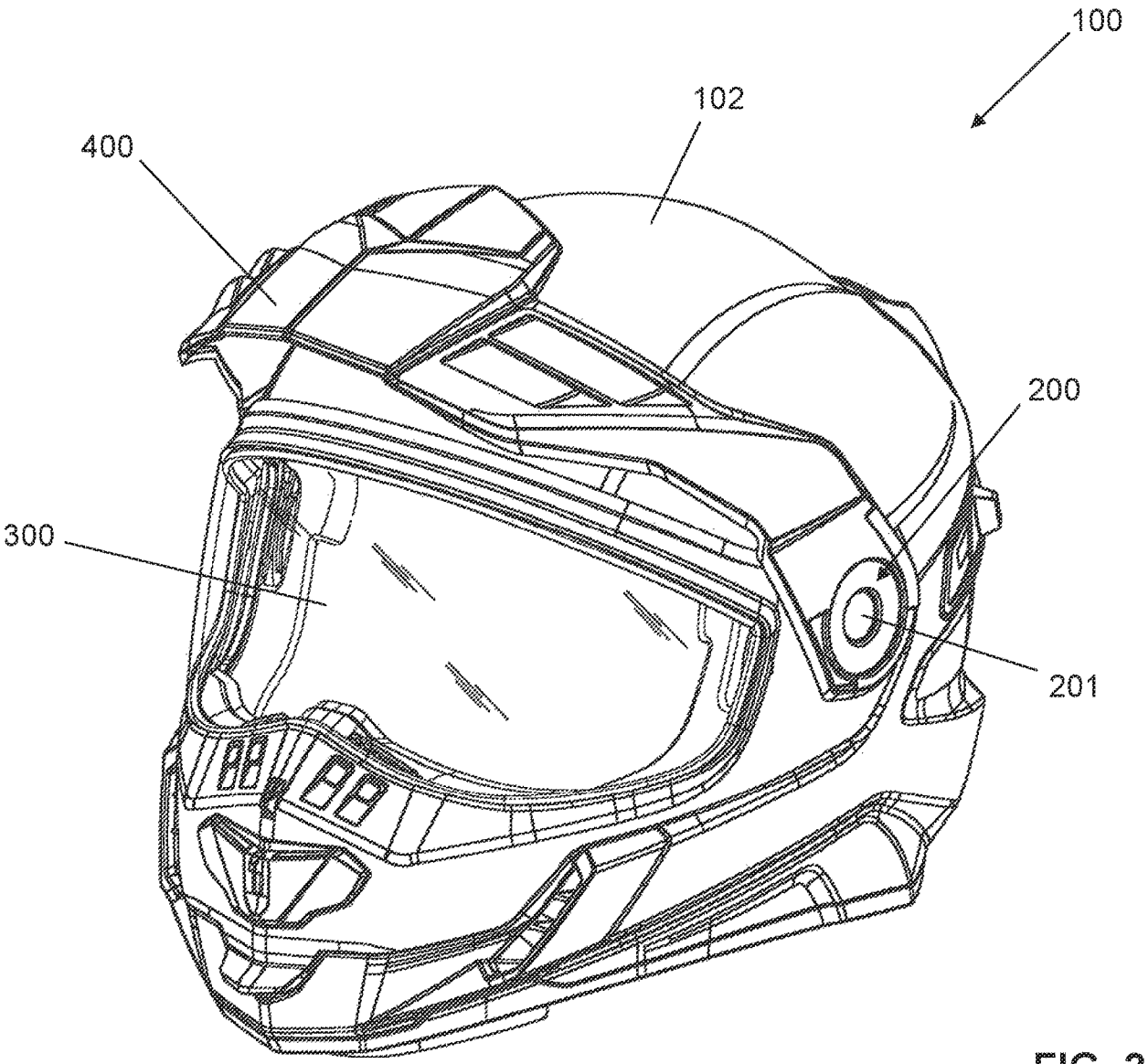
FIG. 2 is a front perspective view of the helmet shown in FIG. 1, showing the peak in a raised position.

In the following description, the same numerical references refer to similar elements. In addition, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the various exemplary embodiments described herein may be used in relation with a snowmobile helmet, for example, it is understood that it may be used with other types of helmets and/or for other purposes. For this reason, the term "helmet" as used herein should not be taken as to limit the scope of the present disclosure as being used with snowmobile helmets in particular. It should be understood that the term "helmet" should, in the context of the present disclosure, encompass all other types of helmets with which the described embodiments could be used and may be useful.

In addition, although the optional configurations as illustrated in the accompanying drawings comprise various components and although the optional configurations of the helmet as shown may consist of certain configurations as explained and illustrated herein, not all of these components and configurations are essential and thus should not be taken in their restrictive sense, i.e. should not be taken as to limit the scope of the present disclosure. It is to be understood that other suitable components and cooperations thereinbetween, as well as other suitable configurations may be used for the helmet, and corresponding parts, as briefly explained, and as can be easily inferred herefrom, without departing from the scope of the disclosure.

Some helmets used in outdoor sports and activities are provided with a mounting system adapted to quickly and efficiently remove and replace the visor of the helmet when needed. The peak can be simply clipped onto the front, top and/or lateral portions of the shell of the helmet, using a separate mounting mechanism, leading to additional required manipulations when customizing the helmet with multiple accessories. The helmet described herein, according to a possible embodiment, is provided with a mounting system adapted to attach and/or allow replacement of several accessories, such as the aforementioned visor and peak, while minimizing the required manipulations. While the described helmet is especially adapted for outdoor activities, such as snowmobiling, motorcycling and/or biking, the helmet can be used for other applications, especially those requiring a visor and/or peak.

As will be explained below in relation to various embodiments, a mounting system for configuring/customizing a helmet is provided. The helmet includes a helmet shell, which surrounds and protects the wearer's head. The mounting system can thus be operated to customize the helmet by allowing one or more helmet accessories to be mounted on the helmet shell. In the various embodiments described herein, the helmet accessories can include a visor and/or a peak, but can further include additional accessories, such as lighting devices (e.g., LEDs) and/or cameras, for example. As should readily be understood by a person skilled in the art, the expression "visor", as used herein, refers to the protective glass covering the front opening of the helmet shell. The "visor" can be provided as a single component, or as an assembly of components. Furthermore, the expression "peak", as used herein, refers to the helmet portion extending above the visor for providing additional protection to the wearer's eyes and face. It is typically provided above the helmet's front opening.

Figure 5:
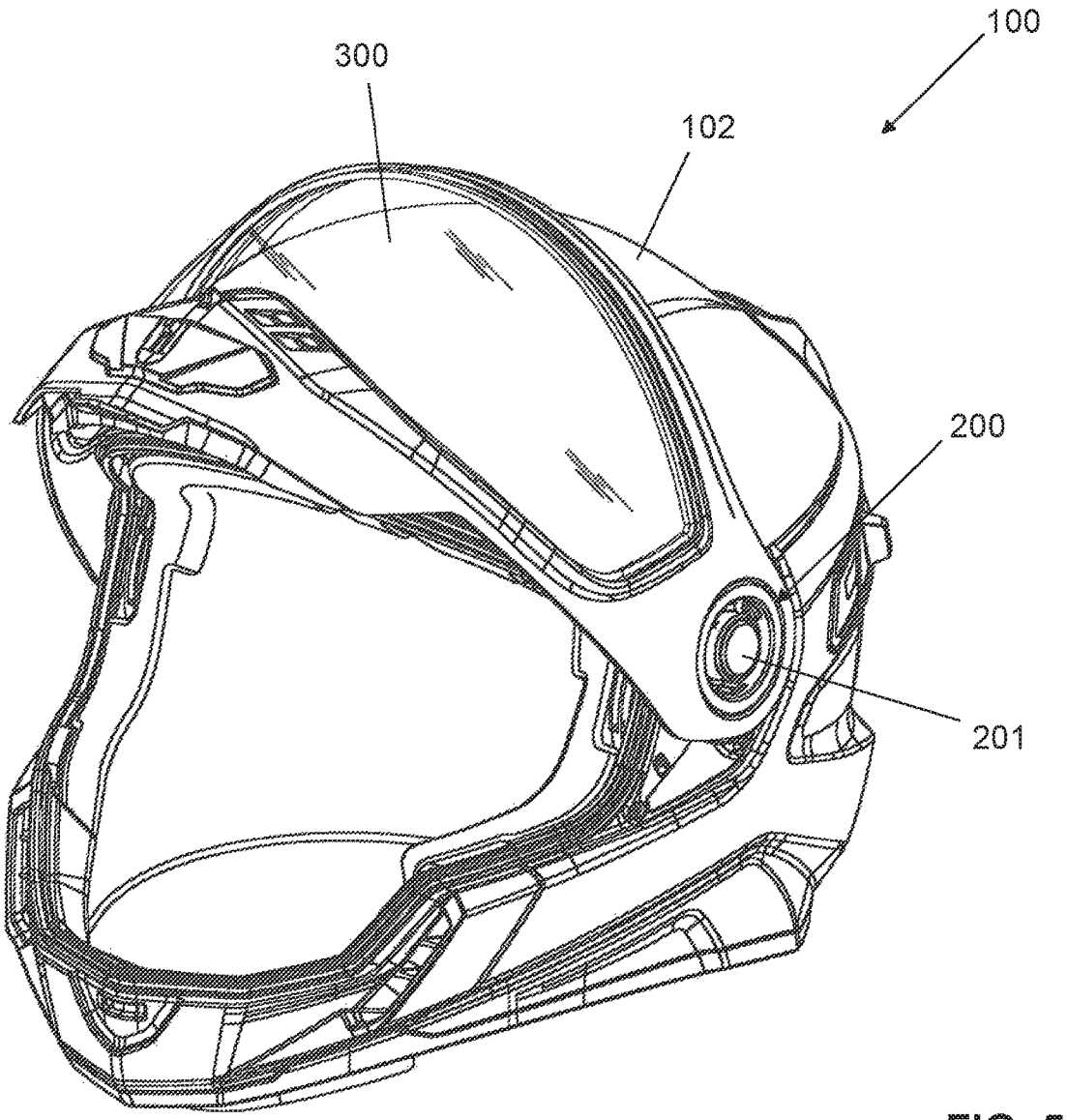
FIG. 5 is a front perspective view of the helmet shown in FIG. 4, showing the visor in the raised position.
Figure 6:
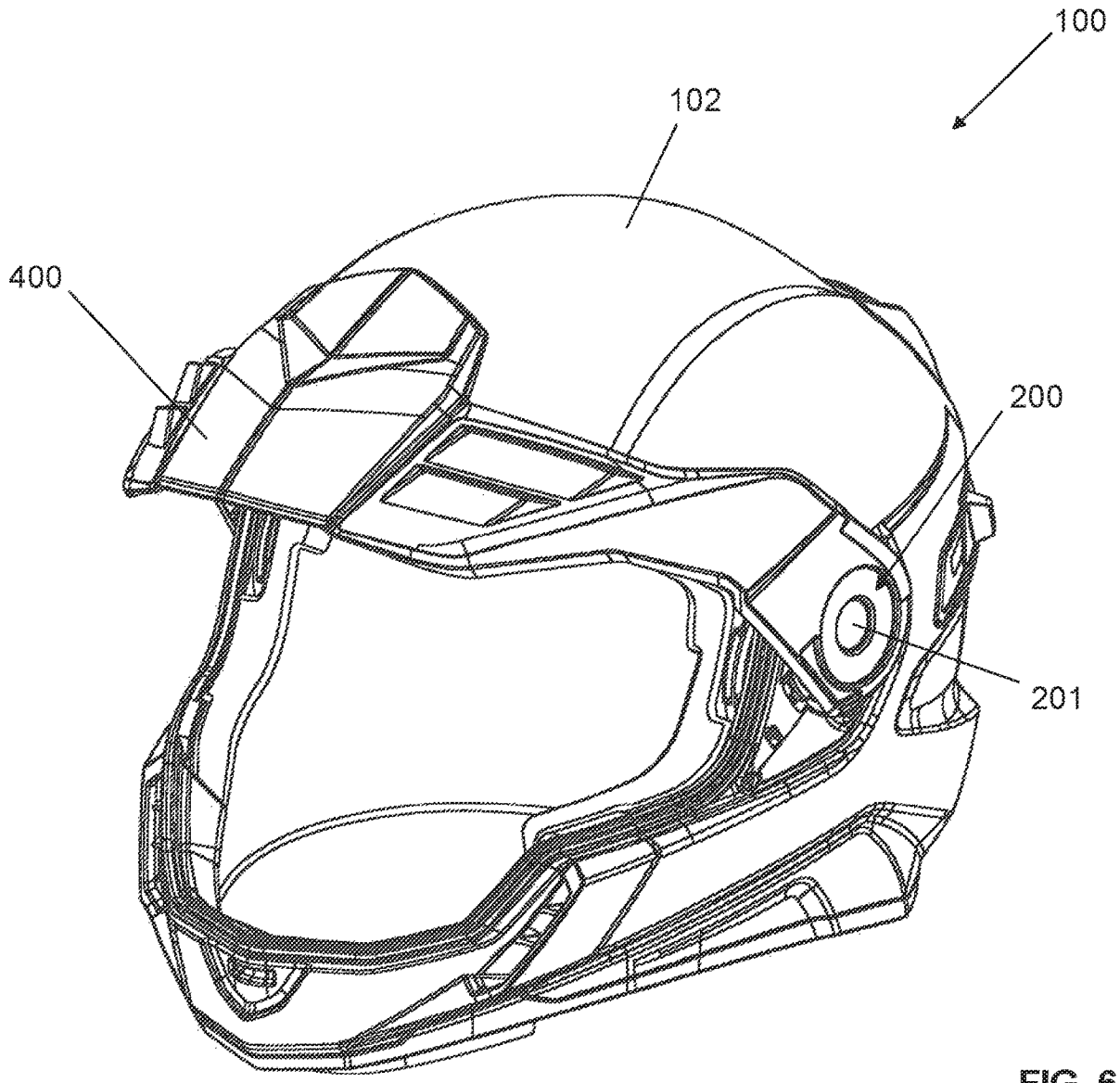
FIG. 6 is a front perspective view of a helmet according to an embodiment, showing the helmet with a peak connected thereto in a lowered position.
Figure 7:
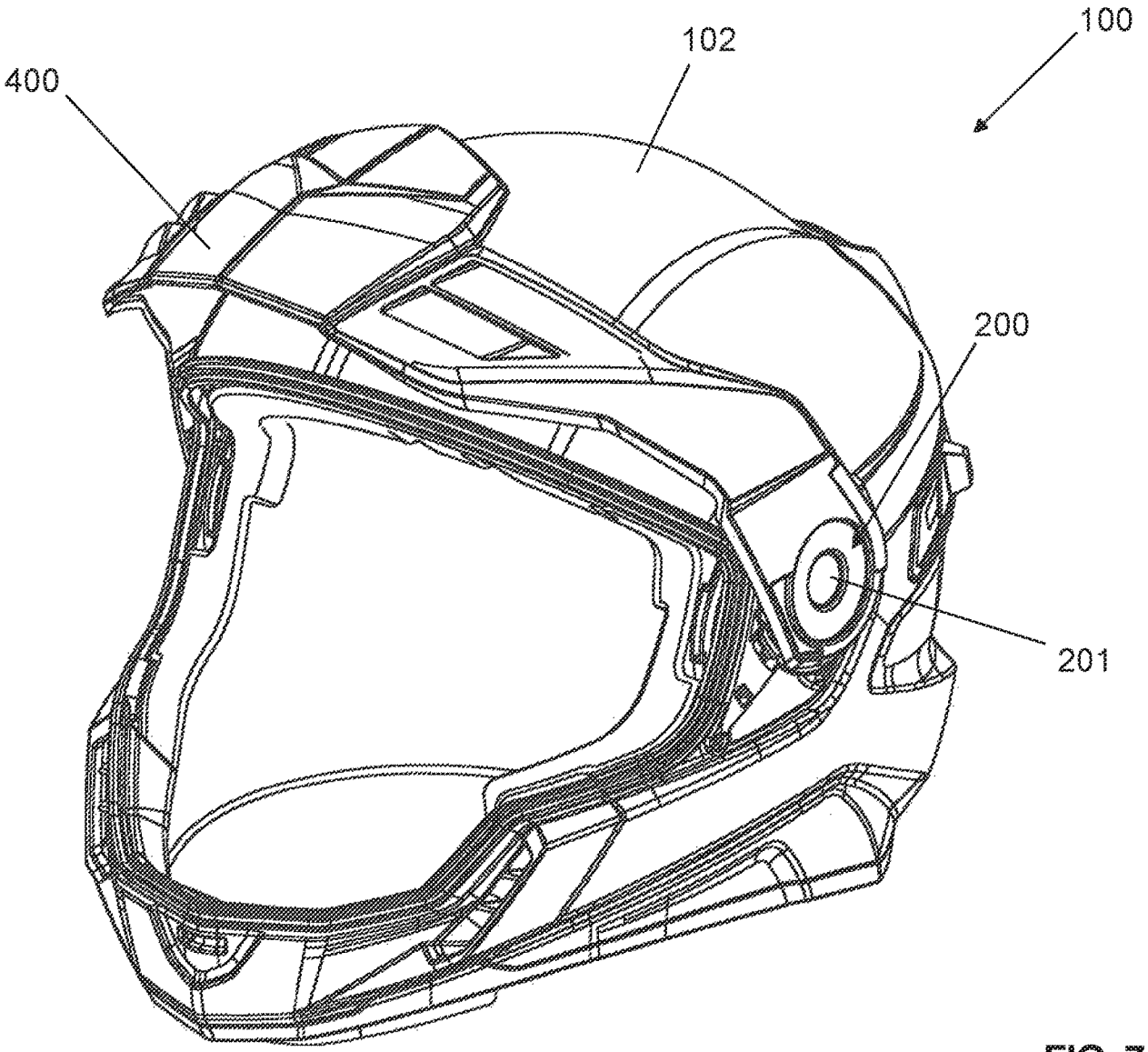
FIG. 7 is a front perspective view of the helmet shown in FIG. 6, showing the peak in the raised position.

Referring to FIGS. 1 through 7, a helmet 100 is shown in accordance with a possible embodiment. In this embodiment, the helmet 100 includes a protective helmet shell 102 having a front opening to allow a wearer to see. Moreover, the helmet 100 includes a mounting system 200 for mounting the helmet accessories on the helmet 100 in a manner that will be described further below. The mounting system 200 can be laterally positioned on the helmet shell 102 on either side thereof. As mentioned above, the helmet accessories can include a visor 300 which can be removably and pivotally mounted to the helmet shell 102 via the mounting system 200. The visor 300 can be shaped and configured to cover partially or completely the front opening of the helmet shell 102 to protect the wearer's face and eyes. The helmet accessories can further include a peak 400 which can be removably mounted to the mounting system 200, in a similar fashion to the visor 300. The helmet 100 can thus be customized, having both the visor 300 and the peak 400 being mounted thereto (FIGS. 1-3), just the visor 300 (FIGS. 4-5), or just the peak 400 (FIGS. 6-7). It is appreciated that the helmet can be worn without any helmet accessories, i.e., without the visor 300 and/or the peak 400.

Figure 3:
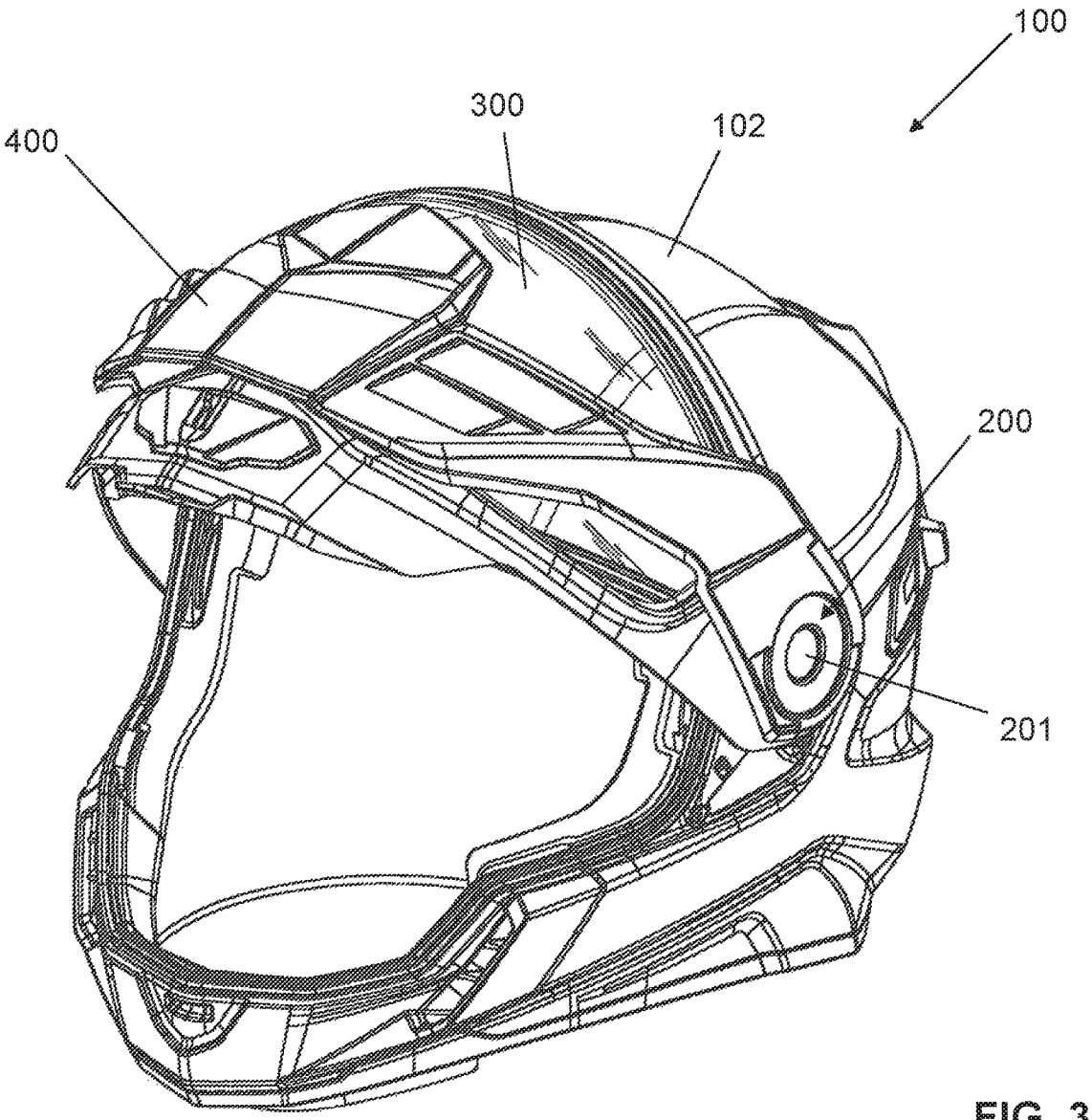
FIG. 3 is a front perspective view of the helmet shown in FIG. 1, showing the visor and the peak in a raised position.
Figure 4:
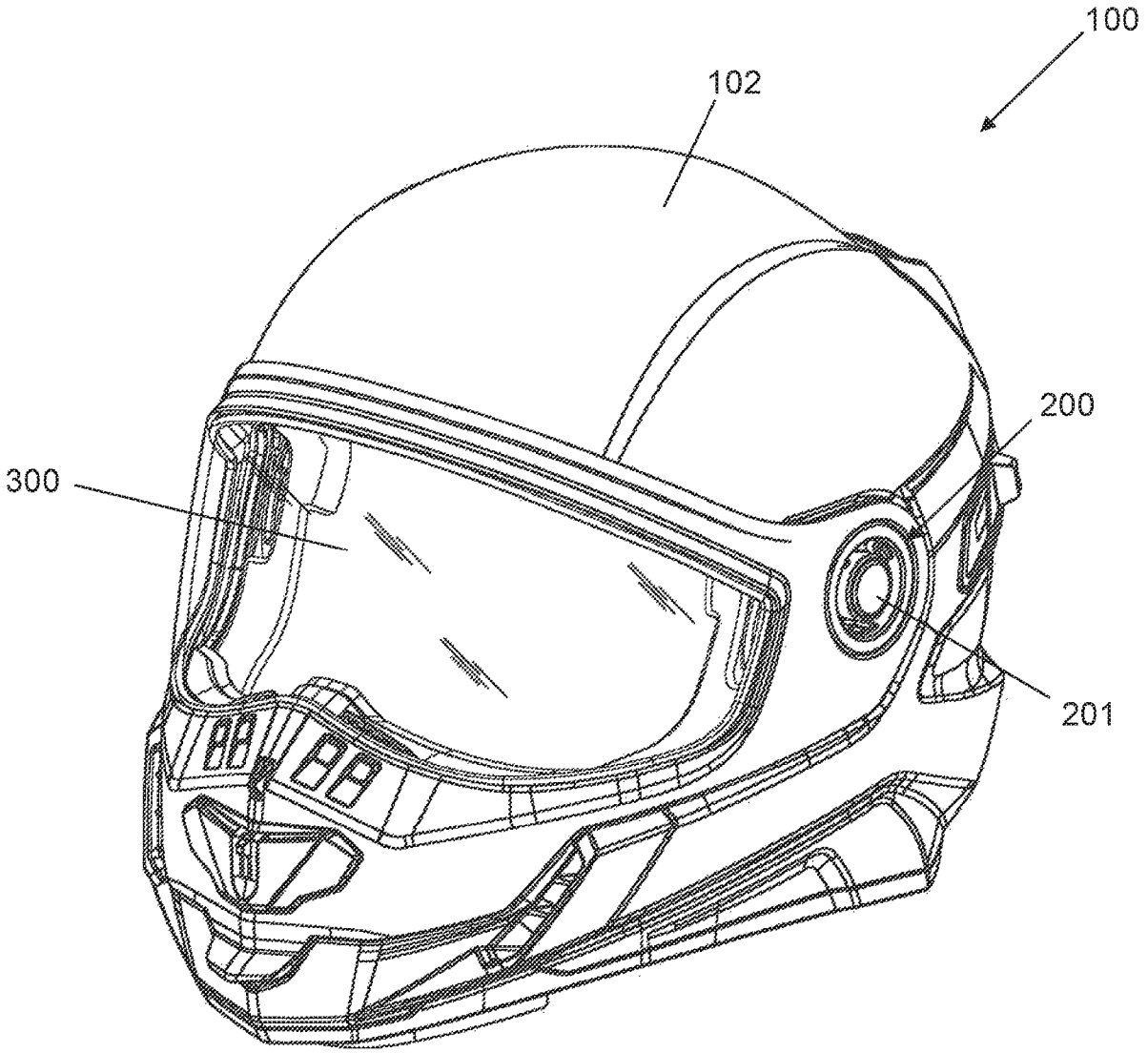
FIG. 4 is a front perspective view of a helmet according to an embodiment, showing the helmet with a visor connected thereto in a lowered position.

In some embodiments, the peak 400 can also be pivotally connected to the mounting system 200 to allow adjustment thereof when needed. In other words, the visor 300 and the peak 400 can be raised and lowered and are thus configurable between a fully raised position and a lowered position. For example, FIG. 1 illustrates the helmet 100 with the visor 300 and the peak 400 in the lowered position (i.e., ready for use), FIG. 3 illustrates the helmet 100 with the visor 300 and the peak 400 in a raised position, while FIG. 5 illustrates the helmet 100 with the visor in the fully raised position. However, it is appreciated that the visor 300 and/or the peak 400 can be adjusted to intermediary positions (i.e. between the fully raised and lowered positions), therefore allowing for additional configurability of the helmet 100, as will be explained further below.

In this embodiment, the mounting system 200 can be manually operated to disengage and disconnect the helmet accessories (i.e, the visor 300 and/or the peak 400) from the helmet shell 102. In the present disclosure, the expression "manually operated" refers to the operation of the mounting system 200 without the use of tools or other mechanisms. In some embodiments, the mounting system 200 can include an actuator 201 for operation thereof. More particularly, the mounting system 200 can be manually operated to disconnect the visor 300 and/or the peak 400 from the helmet shell 102 via the actuator 201. In this embodiment, the mounting system 200 can be adapted to allow disconnection of both the visor 300 and the peak 400 upon operation of the actuator 201, either separately or simultaneously.

Figure 8:
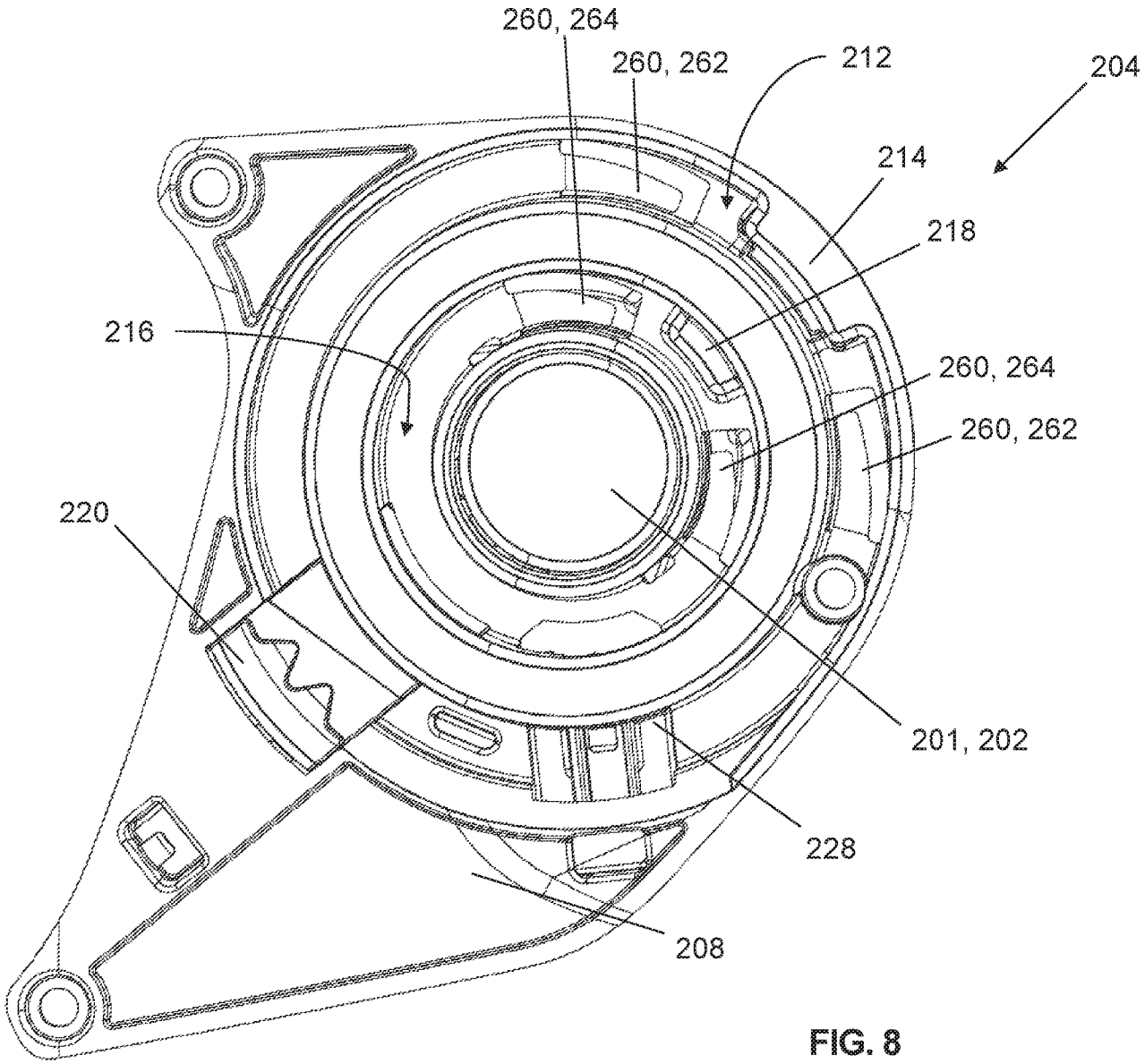
FIG. 8 is a side elevation view of a mounting mechanism according to an embodiment, showing an actuator positioned substantially in the middle thereof.
Figure 9:
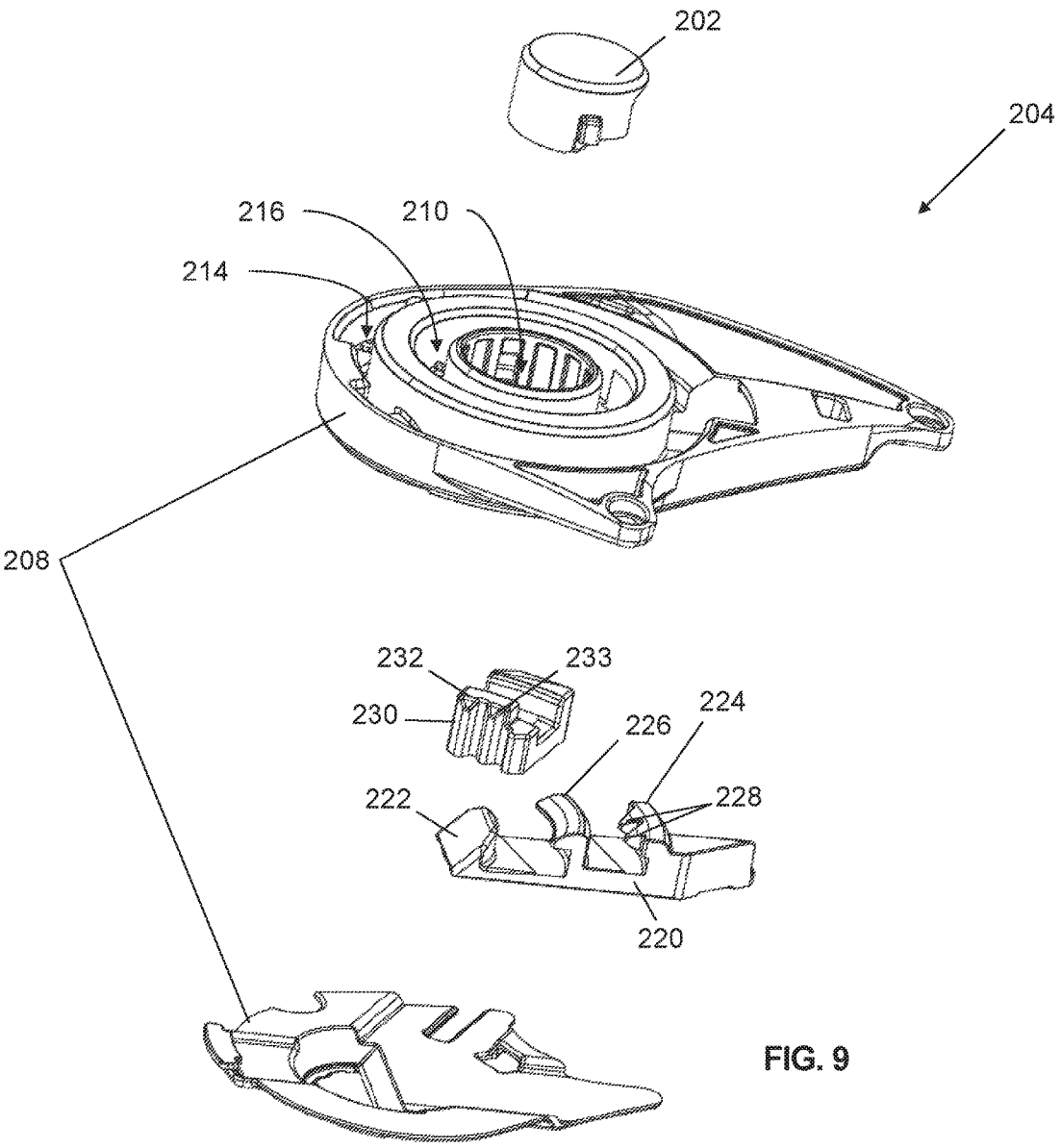
FIG. 9 is an exploded view of the mounting mechanism shown in FIG. 8.

Now referring to FIGS. 8 and 9, the mounting system 200 can include left and right mounting mechanisms 204 positioned on corresponding left and right sides of the helmet shell 102. It will thus be readily understood that the visor 300 and the peak 400 can be connected to both sides of the helmet shell 102. The visor and peak can therefore each include left and right mounting sections removably connectable to the corresponding mounting mechanisms of the mounting system. In the illustrated embodiments, the left mounting mechanism 204 is shown for reference. However, it is understood that the right mounting mechanism can include the same/corresponding structural components as the left mounting mechanism. In the present embodiment, the left mounting mechanism 204 includes a base 208 attachable to the left side of the helmet shell 102. The base 208 can include the actuator 201 required to operate the mounting mechanism 204, as described above. However, it is appreciated that the actuator 201 can alternatively be located at any suitable position on the helmet shell 102, while remaining operatively connected to the mounting mechanism 204. In some embodiments, the actuator 201 can be a pushbutton 202 inserted into a central opening 210 of the base 208. It should thus be understood that pushing the pushbutton 202 effectively operates the mounting mechanism 204, disengaging the visor 300 and/or peak 400 therefrom. In some embodiments, the pushbutton 202 can be operable (i.e., pushed) at different positions. For example, pushing the pushbutton 202 at a first level (e.g., halfway within the opening 210) can disengage the visor 300, and pushing the pushbutton 202 at a second level (e.g., fully pushed within the opening 210) can disengage the peak 400. In alternate embodiments, the actuator 201 can be any suitable mechanism adapted to be manually operated by a user, such as a lever for example, or any other similar device and/or mechanism.

In some embodiments, the helmet can include a single mounting mechanism, positioned either on the left or right side of the helmet shell. As such, the side of the helmet shell opposite the mounting mechanism can be configured to have the visor and/or peak be hooked, clipped or otherwise removably attached thereto in order to be connected to the helmet. As such, the user would only need to operate one mounting mechanism in order to disengage the visor and/or peak from the helmet shell.

Now referring to FIGS. 10A to 11B, in addition to FIGS. 8 and 9, the visor 300 can include left and right visor mounting sections 302 respectively connectable to the left and right mounting mechanisms 204. More specifically, each visor mounting section 302 can include a visor flange 304 adapted to engage the mounting mechanisms to effectively connect the visor mounting sections thereto. In some embodiments, the base 208 can be adapted to receive the visor mounting section 302 to connect the visor 300 to the helmet shell 102. More specifically, the base 208 can include a visor channel 212 adapted to receive the visor flange 304 therein. The visor channel 212 and visor flange 304 can have complementary shapes to facilitate cooperation. In this exemplary embodiment, the visor channel 212 is annular and surrounds the opening 210. The visor flange 304 is therefore also annular and is adapted to connect to the mounting mechanism 204 within the annular visor channel 212. It is appreciated that other shapes can be suitable in order for the mounting mechanism 204 and visor flange 304 to cooperate with one another to connect the visor to the helmet.

Figure 10B:
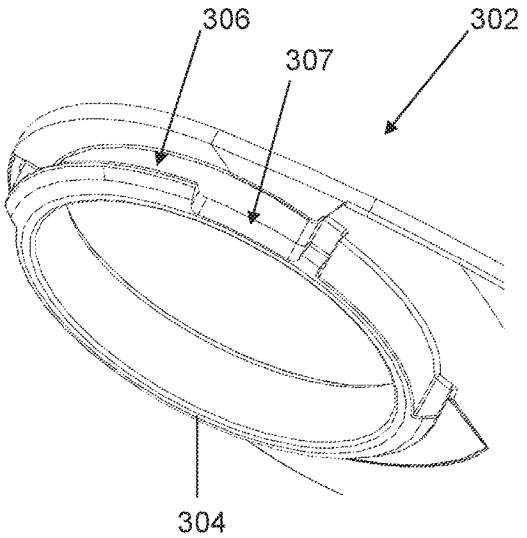
FIG. 10B is an enlarged view of the visor mounting section shown in FIG. 10A.
Figure 11A:
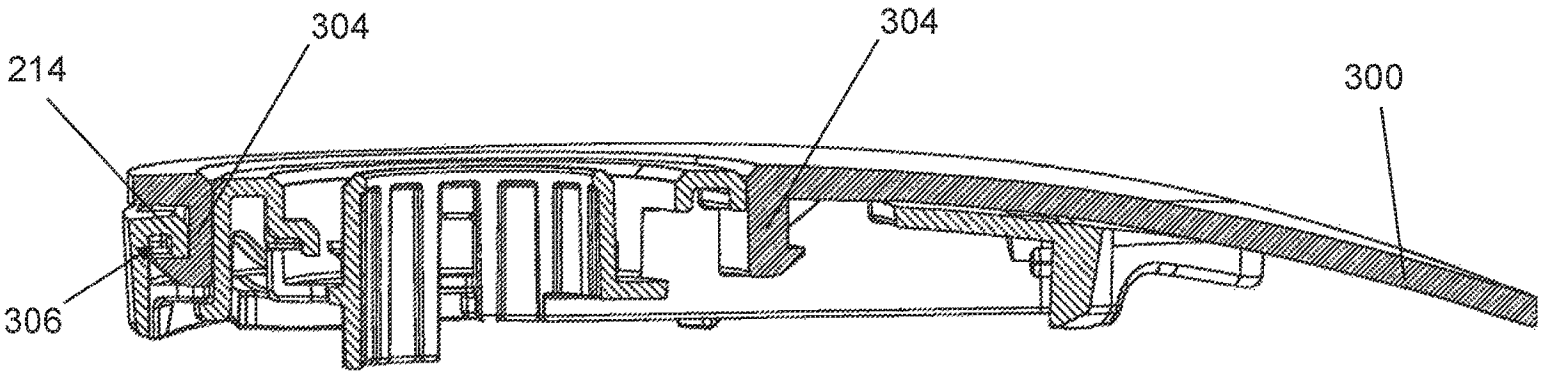
FIGS. 11A and 11B are cross-sectional views of the right side of the helmet according to an embodiment, showing the cooperation between the visor and the mounting mechanism.
Figure 11B:
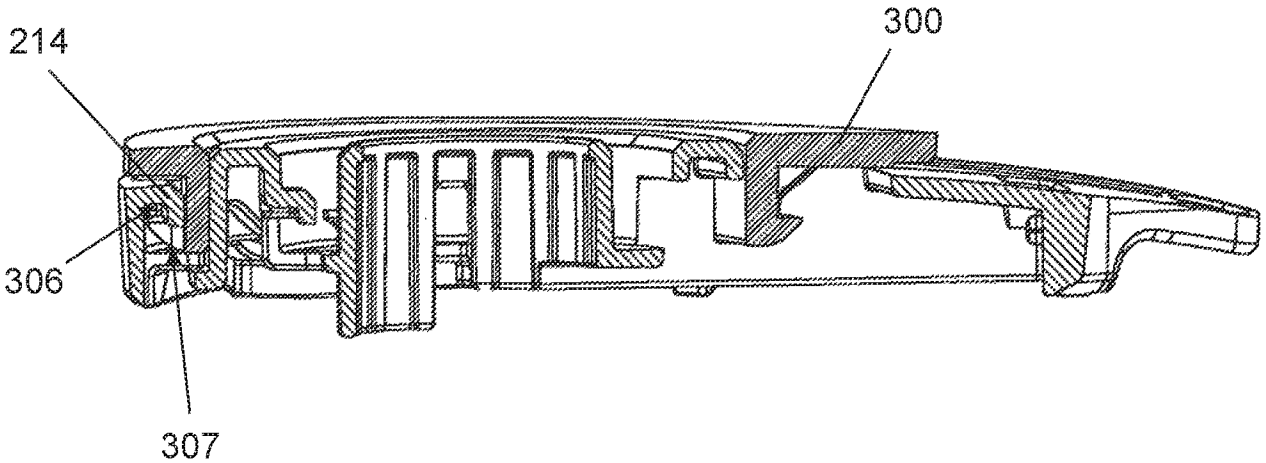

In this embodiment, the visor flange 304 includes a visor key path 306, and the visor channel 212 includes a visor lock 214 adapted to engage the visor key path 306 and secure the visor mounting section 302 to the mounting mechanism 204. As seen in FIGS. 10B and 11B, the visor key path 306 can have a visor key path opening 307 to allow the visor lock 214 to extend within the key path 306. It is noted that, in this embodiment, the visor lock 214 overhangs the visor channel 212, requiring that the visor key path opening 307 be aligned with the visor lock 214 to allow thorough insertion of the visor flange 304 within the visor channel 212. In this embodiment, the visor lock 214 aligns with the key path opening 307 when the visor is positioned in the raised position, as illustrated in FIG. 11B. Once the lock 214 accesses the visor key path 306 through the opening 307, the visor flange 304 can rotate (e.g., by rotating the visor 300 in the lowered position) in order for the visor lock 214 to slide further within the visor key path 306. It should thus be understood that rotating the visor 300 in the opposite direction effectively re-aligns the visor lock 214 with the visor key path opening 307, therefore allowing the visor flange 304 to disengage the visor channel 212. It is appreciated that in alternative embodiments, the visor channel 212 and visor flange 304 can have any suitable shape or size to allow the flange to engage the channel. Furthermore, the visor flange 304 can be secured within the visor channel 212 using any suitable method, such as a hooking mechanism, or a retaining pin for example.

Figure 12B:
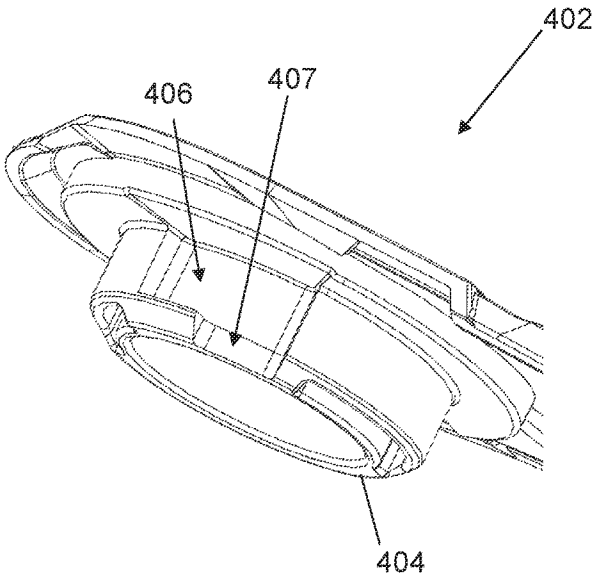
FIG. 12B is an enlarged view of the peak mounting section shown in FIG. 12A.
Figure 12C:
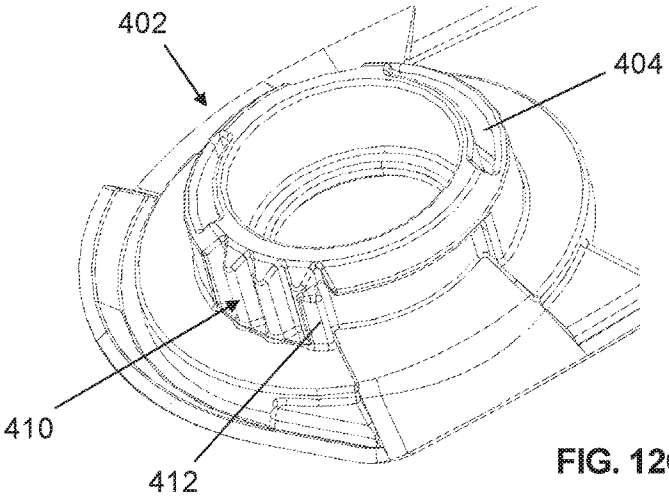
FIG. 12C is a perspective view of the peak mounting section shown in FIG. 12B, showing a serrated surface according to an embodiment.
Figure 12A:
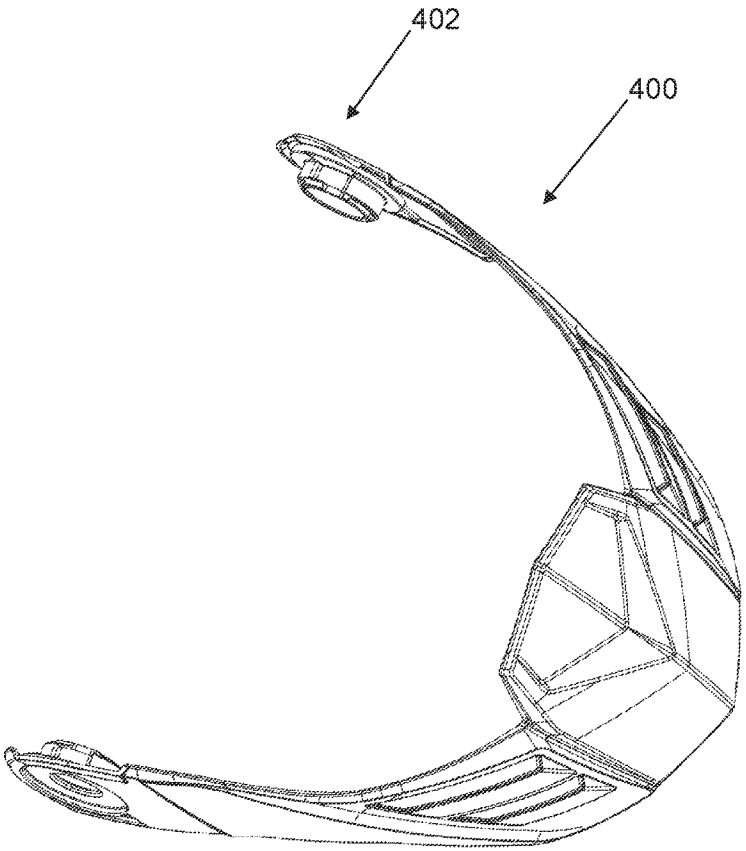
FIG. 12A is a perspective view of a peak according to an embodiment, showing the peak having peak mounting sections at each end.

Now referring to FIGS. 12A and 12B, in addition to FIGS. 8 and 9, the peak 400 can include left and right peak mounting sections 402 respectively connectable to the left and right mounting mechanisms 204. More specifically, each peak mounting section 402 can include a peak flange 404 adapted to engage the mounting mechanisms to effectively connect the peak mounting sections thereto. In some embodiments, the base 208 can be adapted to receive the peak mounting section 402 for mounting the peak 400 on the helmet shell 102, similarly to the connection of the visor mounting section 302 to the base 208 described above. More specifically, the base 208 can include a peak channel 216 adapted to receive the peak flange 404 therein. It should be noted that the peak channel 216 and peak flange 404 can have complementary shapes to facilitate cooperation therebetween. In the present embodiment, the peak channel 216 is annular and surrounds the opening 210 of the base 208. The peak flange is thus also annular and is adapted to connect to the mounting mechanism 204 within the annular peak channel 216. In some embodiments, the annular visor channel 212 and annular peak channel 212 can be concentrically positioned around the opening 210, with the visor channel 212 having a greater radius than the peak channel 216, as illustrated in FIG. 8 for example. However, it is appreciated that in other embodiments, the peak channel can have a greater radius than the visor channel.

In this embodiment, the peak flange 404 includes a peak key path 406, and the peak channel 216 includes a peak lock 218 adapted to engage the peak key path 406 and secure the peak mounting section 402 to the mounting mechanism 204. As seen in FIG. 12B, the peak key path 406 can have a peak key path opening 407 allowing access to the peak lock 218. It is noted that, in this embodiment, the peak lock 218 overhangs the peak channel 216, requiring that the peak key path opening 407 be aligned with the peak lock 218 to allow thorough insertion of the peak flange 404 within the peak channel 216. Once the peak lock 218 accesses the peak key path 406 through the opening 407, the peak flange 404 can rotate (e.g., by rotating the peak 400) in order for the peak lock 218 to slide further within the peak key path 406. It should thus be understood that rotating the peak 400 in the opposite direction can re-align the peak lock 218 with the peak key path opening 407, therefore allowing the peak flange 404 to disengage the peak channel 216. It is appreciated that in alternative embodiments, the peak channel 216 and peak flange 404 can have any suitable shape or size to allow the flange to engage the channel. Furthermore, the peak flange 404 can be secured within the peak channel 216 using any suitable method, such as a hooking mechanism, or a retaining pin for example.

Figure 13B:
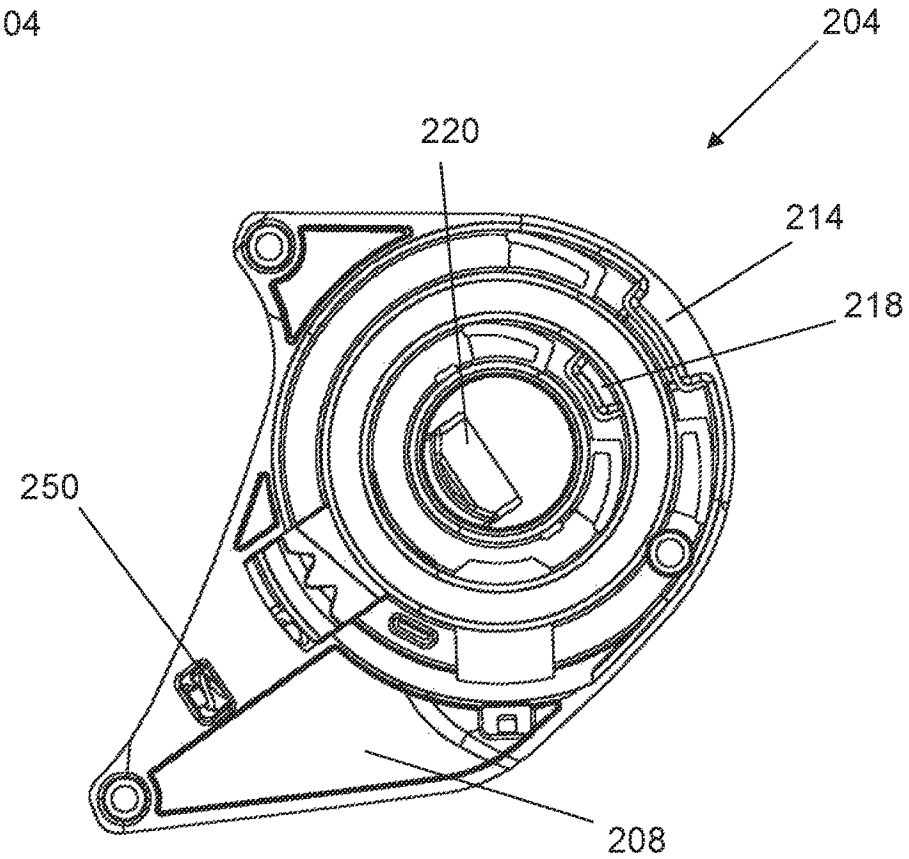
FIGS. 13A and 13B are side elevation views of a mounting mechanism, showing a first slider in an engaged configuration (FIG. 13A) and in a disengaged configuration (FIG. 13B).
Figure 13A:
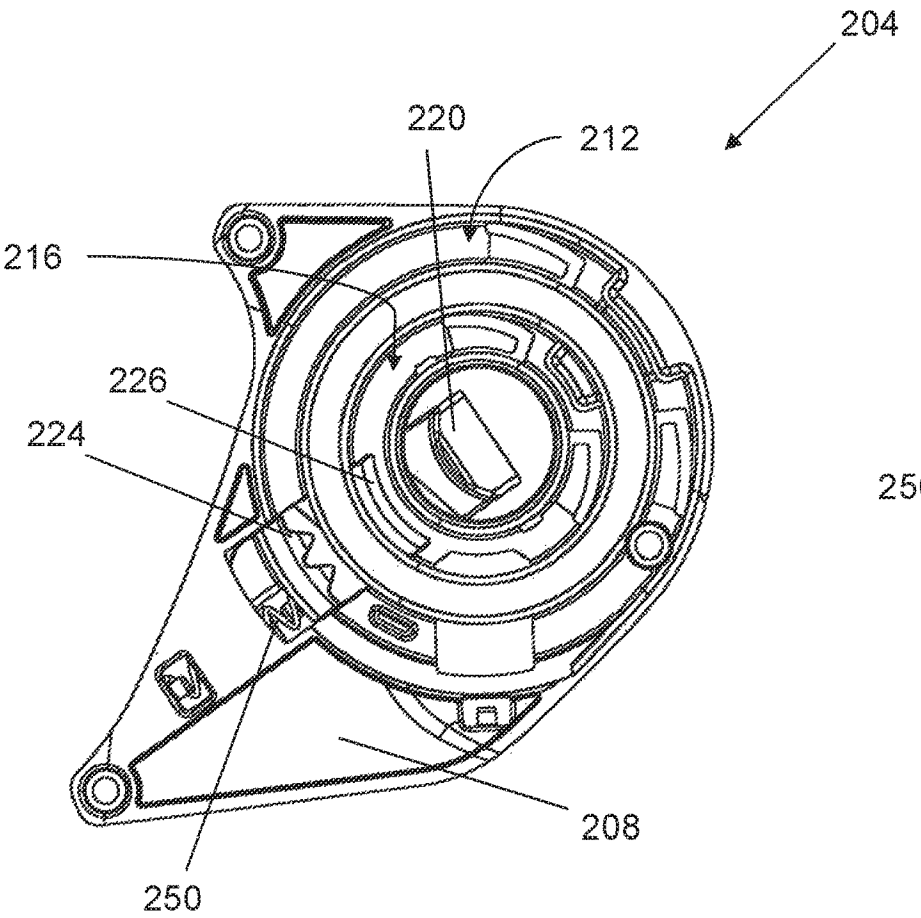
Figure 14A:
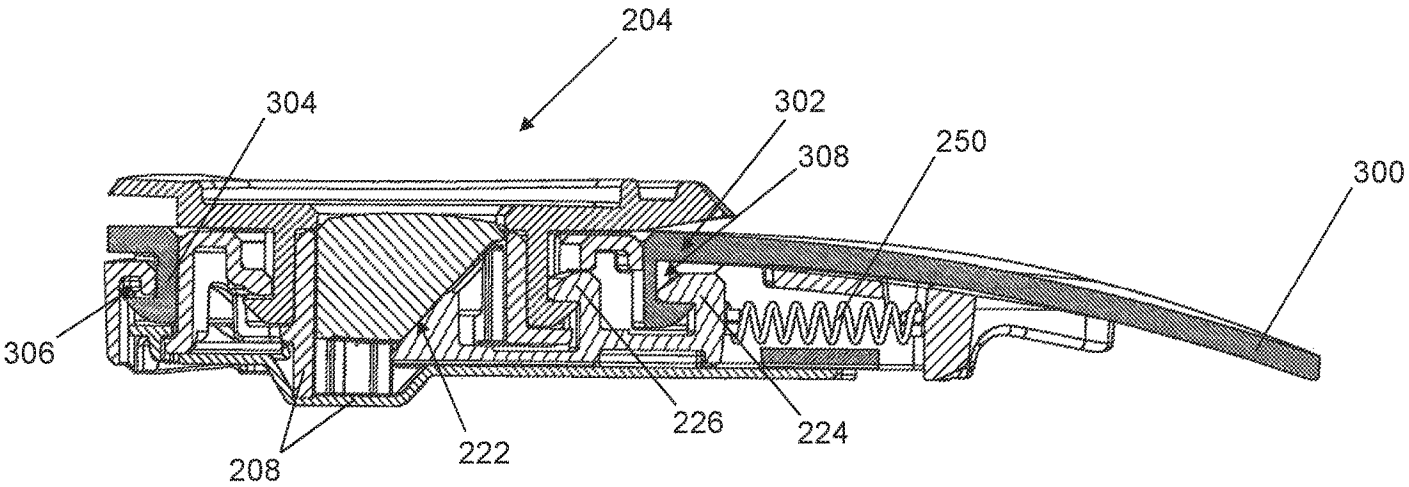
FIGS. 14A and 14B are cross-sectional views of the right side of the helmet according to an embodiment, showing the cooperation of the first slider with the visor and the peak.
Figure 14B:
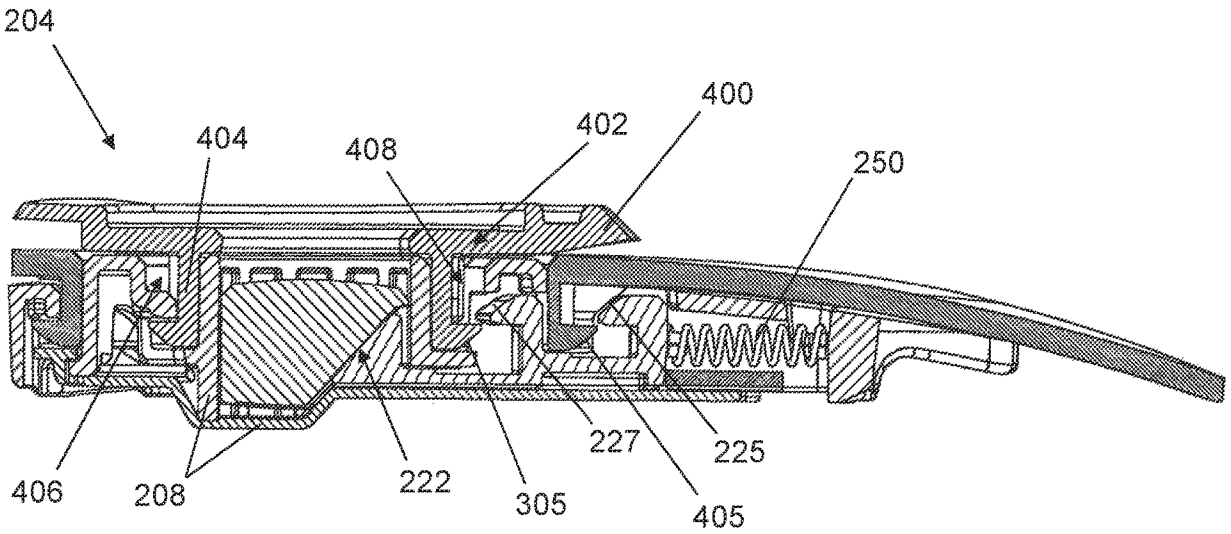

Now referring to FIGS. 13A to 14B, the mounting mechanism 204 can further include a mechanism adapted to engage and/or retain the visor and peak mounting sections 302,402 on the mounting mechanism 204. In an exemplary embodiment, the mounting mechanism 204 includes a first slider 220 operably connected to the base 208 to engage and secure the visor and peak mounting sections 302, 402 to the mounting mechanism 204. In this embodiment, the first slider 220 can be adapted to disengage the mounting sections 302, 402 upon operation of the actuator 201 (i.e., pushing the pushbutton 202). More specifically, the first slider 220 and pushbutton 202 can include complementary surfaces 222 cooperating in a manner such that the first slider 220 slides away from the pushbutton 202 upon pushing the pushbutton 202, thus disengaging the visor and peak mounting sections. Therefore, it should be understood that the first slider 220 can have at least two configurations, an engaged configuration (FIGS. 13A and 14A) and a disengaged configuration (FIGS. 13B and 14B). In some embodiments, the first slider 220 can be spring-loaded so as to be biased in the engaged configuration when the pushbutton is released (i.e., not pushed down). In this embodiment, the mounting mechanism 204 includes a spring 250 operatively connecting the base 208 and the first slider 220. It should be understood that pushing the pushbutton 202 causes the first slider 220 to slide, which compresses the spring 250. Then, once the pushbutton is released, the spring 250 extends to a resting position, urging the first slider 220 back into the engaged configuration.

It should be noted that the first slider 220 can provide additional security regarding the connection of the visor 300 and/or peak 400 to the helmet shell 102 with respect to the previously described locking mechanisms (i.e., the visor lock/visor key path and the peak lock/peak key path). In other words, the mounting sections 302, 402 can remain connected to the mounting mechanism via the first slider 220 even after having disengaged the lock elements 214, 218 from the corresponding key paths. It is appreciated that, in other embodiments, the visor and peak mounting sections 302, 402 can be retained and secured to the mounting mechanism 204 via alternate mechanism(s) than that described above (i.e., the slider 220). For example, ball-bearing connectors, such as those used for drill-bit connections or hose couplers, can be used to connect the mounting sections to the mounting mechanism 204.

Still referring to FIGS. 13A to 14B, the first slider 220 includes a visor engaging element 224 extending therefrom and being adapted to effectively engage and retain the visor flange 304 within the visor channel 212. As seen in FIGS. 14A and 14B, the visor mounting section 302 can further include a visor groove 308 adapted to cooperate with the visor engaging element 224. The visor groove 308 can be located on the visor flange 304, opposite the visor key path 306. More specifically, the visor engaging element 224 can extend within and hook onto the visor groove 308 when the first slider 220 is in the engaged position, therefore securing the visor mounting section 302 to the mounting mechanism 204. It is appreciated that the visor groove 308 can be an extension of the visor key path 306 around the visor flange 304, however, in this embodiment, the visor key path 306 and the visor groove 308 are two separate elements. The peak 400 can be similarly configured, in that the peak flange 404 can include a peak groove 408, and the first slider 220 can include a peak engaging element 226 adapted to cooperate with the peak groove 408. As described above with respect to the visor 300, the peak groove 408 can be positioned opposite the peak key path 406 along the peak flange 404, and can be configured to have the peak engaging element 226 extend therein to hook the peak mounting section 402 to the mounting mechanism 204. It should be noted that the peak groove 408 can be an extension of the peak key path 406 around the peak flange 404.

Referring back to FIG. 13A, when the first slider 220 is in the engaged configuration, the visor and peak engaging elements 224, 226 can be positioned within the visor channel 212 and peak channel 216 respectively. Therefore, in order to insert the visor flange 304 or peak flange 404 within the corresponding channels, the first slider 220 needs to be operated to remove the engaging elements 224, 226 from the channels 212, 216, as illustrated in FIG. 13B. Once the engaging elements are moved, the visor and/or peak flanges 304, 404 can be inserted within the channels of the base 208, and the first slider 220 can then be released to secure the flanges via the engaging elements. However, in some embodiments, the edges of the engaging elements can be forwardly inclined (or tapered) to facilitate insertion of the visor flange and peak flange. As seen in FIG. 14B, the visor and peak engaging elements 224, 226 respectively include an inclined forward edge 225, 227 adapted to facilitate the connection of the visor and peak mounting sections 302, 402 to the mounting mechanism 204. It should be understood that, in order to insert the visor and/or peak flanges within the corresponding channels, one must simply apply pressure onto one or both engaging elements 224, 226 to displace the first slider 220 in the disengaged configuration and allow insertion of the flanges 304, 404 within the channels. In addition, in this embodiment, the visor and peak flanges can be respectively provided with an inclined flange edge 305, 405 having a similar angle as the inclined forward edge of the engaging elements 224, 226. The flange edges 305, 405 can therefore be adapted to cooperate with the inclined forward edges 225, 227 to facilitate the insertion of the flanges within the channels of the base 208.

In some embodiments, and as seen in FIG. 9, the visor engaging element 224 can be provided with one or more prongs 228 adapted to engage the visor groove 308.

Furthermore, the visor groove 308 can have one or more serrated surfaces 310 (FIG. 10C) complementarily shaped with respect to the prongs 228. It should thus be understood that when the prongs 228 engage the serrated surface, rotation of the visor 300 is blocked, or at least obstructed. In this embodiment, the visor engaging element 224 has two prongs 228 adapted to engage the serrated surface of the visor groove 308. It is appreciated that the prongs 228 can be further adapted to secure the visor 300 in various predetermined positions when rotating the visor. For example, and as seen in the exemplary embodiment of FIG. 10C, the visor mounting section 302 can include a plurality of serrated surfaces 310 positioned at different locations around the visor flange 304 for securing the visor 300 in various positions. In some embodiments, the pushbutton 202 must be pushed in order to allow rotation of the visor 300 due to the engagement of the prongs 228 with the serrated surface. However, it is appreciated that the visor 300 can be rotated without having to push the pushbutton 202 by rotating the visor 300 with sufficient force to compress the spring 250, thus disengaging the prongs and allowing rotation.

Figure 10C:
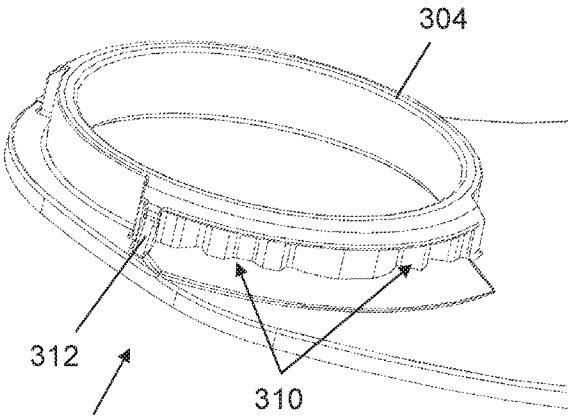
FIG. 10C is a perspective view of the visor mounting section shown in FIG. 10B, showing a serrated surface according to an embodiment.
Figure 10A:
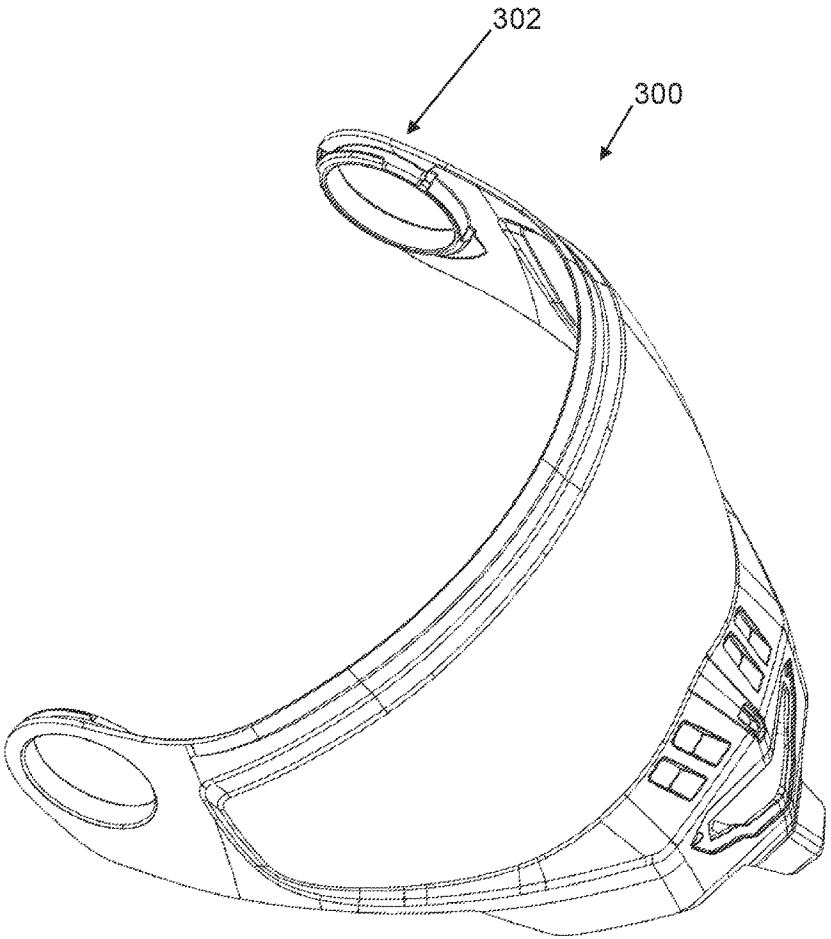
FIG. 10A is a perspective view of a visor according to an embodiment, showing the visor having visor mounting sections at each end.

With reference to FIGS. 8 to 10C, the visor 300 can include safety features adapted to prevent accidental disconnection/disengagement of the visor 300 from the mounting mechanisms 204. For example, movement of the visor 300 can be at least partially prevented prior to pushing the pushbutton 202, effectively preventing accidental disconnection of the visor 300. In this embodiment, the visor flange 304 includes a visor stop 312 shaped and sized to have the visor engaging element 224 (FIG. 9) abut thereon upon rotation of the visor 300 (i.e., when attempting to raise the visor 300) prior to pushing the pushbutton 202. Consequently, the visor lock 214 (FIG. 8) cannot be aligned with the visor key path opening 307, thus preventing disengagement of the visor 300. As seen in FIG. 10C, the visor stop 312 is located adjacent the serrated surfaces 310 of the visor flange 304. However, it is appreciated that other safety features, or embodiments thereof, are possible for preventing accidental disengagement of the visor 300, such as an additional mechanical lock for example.

Figure 15B:
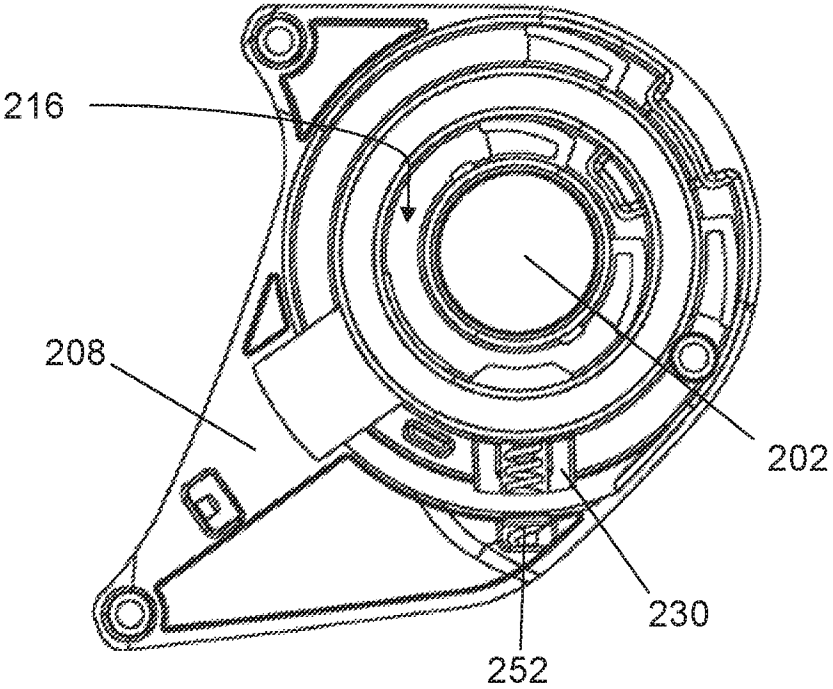
FIGS. 15A and 15B are side elevation views of a mounting mechanism, showing a secondary slider in an engaged configuration (FIG. 15A) and in a disengaged configuration (FIG. 15B).
Figure 15A:
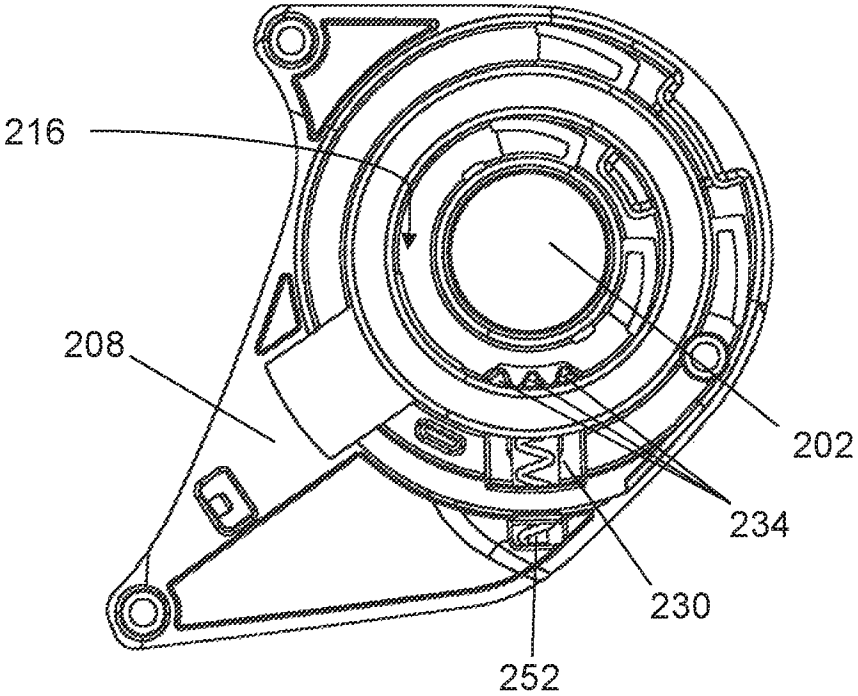

Now referring to FIGS. 15A and 15B, in addition to FIG. 9, the mounting mechanism 204 can further include a secondary slider 230 operatively connected to the base 208. In some embodiments, the secondary slider 230 includes a secondary peak engaging element 232 adapted to engage and further secure the peak. More specifically, the secondary peak engaging element 232 can be adapted to engage and hook onto the peak mounting section. Additionally, the secondary peak engaging element 232 can include one or more prongs 234, as described above in relation to the visor engaging element 224, and the peak flange 404 can include one or more serrated surface 410 (FIG. 12C) shaped and sized to receive said prongs 234. It should thus be understood that the secondary slider 230 can be adapted to prevent, or at least provide resistance to the rotation of the peak. It should be noted that the prongs of the secondary peak engaging element can be further adapted to secure the peak 400 in various predetermined positions, similar to the prongs of the visor engaging element 224 described above.

With reference to FIGS. 12A to 12C, in addition to FIGS. 8 and 9, the peak 400 can also include safety features adapted to prevent accidental disconnection/disengagement of the peak 400 from the mounting mechanism 204. In a similar fashion as the visor 300, movement of the peak 400 can be at least partially prevented prior to pushing the pushbutton 202, effectively preventing accidental disconnection of the visor 400. In this embodiment, the peak flange 404 includes a peak stop 412 shaped and sized to have the peak engaging element 226 (FIG. 9) abut thereon upon rotation of the peak 400 (i.e., when attempting to raise the peak 400) prior to pushing the pushbutton 202. Consequently, the peak lock 218 (FIG. 8) cannot be aligned with the peak key path opening 407, thus preventing disengagement of the peak 400. As seen in FIG. 12C, the peak stop 412 is located adjacent the serrated surface 410 of the peak flange 404. However, it is appreciated that other safety features and embodiments thereof are possible for preventing accidental disengagement of the peak 400, such as an additional mechanical lock for example.

In the present embodiment, the secondary slider 230 can be operated in an engaged configuration (FIG. 15A) and a disengaged configuration (FIG. 15B). In addition, the secondary slider 230 can be spring-loaded so as to be biased in the engaged configuration. More particularly, the mounting mechanism 204 can include a second spring 252 operatively connecting the base 208 with the secondary slider 230. In some embodiments, the secondary peak engaging element 232 has an inclined forward edge 233 (FIG. 9) adapted to facilitate insertion of the peak flange within the peak channel 216. It is appreciated that pushing on the inclined forward edge 233 with the peak flange can displace the secondary slider 230 in the disengaged configuration, which reverts to the engaged configuration once the peak flange is thoroughly inserted within the channel 216. In this embodiment, the secondary slider 230 can be disengaged by simply rotating the peak in the desired direction and with sufficient force to compress the second spring 252. However, it is appreciated that the secondary slider 230 can be operated using a second actuator such as a second pushbutton or lever for example. Alternatively, the pushbutton 202 can be adapted to disengage both the first and secondary sliders simultaneously.

Referring back to FIG. 8, the mounting mechanism 204 can include biasing elements 260 adapted to push the visor and/or peak mounting sections away from the base 208 when the sliders and key path locks are disengaged. Therefore, it is appreciated that removal of the helmet accessories can be facilitated with the help of the biasing elements 260. In some embodiments, the biasing elements 260 can be spring boards positioned within the visor and/or peak channels 212, 216, the spring boards being adapted to push at least one of the visor and peak flanges away from the base 208 (i.e., out of the corresponding channel). In this embodiment, the mounting mechanism 204 includes two pairs of biasing elements 260, a first pair being visor biasing elements 262, and a second pair being peak biasing elements 264. As mentioned above, the visor biasing elements 262 are positioned within the visor channel 212, and the peak biasing elements 264 are positioned within the peak channel 216. However, it is appreciated that the mounting mechanism can include any suitable number of biasing elements, and that said elements can be positioned at any suitable location on or around the base 208 to effectively facilitate disconnection of the visor and/or peak from the helmet.

Referring broadly to FIGS. 1 to 15B, a method of configuring the helmet 100 with helmet accessories is provided. Firstly, starting with the helmet 100 having the visor 300 and peak 400 being connected thereto in the lowered position (FIG. 1), the wearer must operate the actuator 201 (i.e., the pushbutton 202) to disengage the first slider 220 and ease rotation of the visor 300. Then, the wearer can rotate the visor 300 and/or the peak 400 into the raised position to align the visor lock 214 with the visor key path opening 307, and align the peak lock 218 with the peak key path opening 407. In some embodiments, the visor 300 and/or peak 400 have to be in the fully raised position in order to align the locks with the corresponding path opening. Once aligned, the biasing elements 260 can effectively push the mounting sections 302, 402 away from the mounting mechanisms 204 to allow removal of the visor 300 and peak 400. It should be understood that the pushbutton 202 must remain pushed during the rotation of the visor 300 and peak 400, otherwise the visor and peak engaging elements would re-engage and hook onto the corresponding mounting sections, preventing the biasing elements from pushing the accessories outwardly. In this embodiment, it should be noted that the peak 400 must be disconnected prior to the visor 300 since the peak 400 overlaps the visor 300 when both are connected to the helmet 100. To reconnect the accessories to the helmet 100, the visor and peak flanges 304, 404 must first be aligned with the corresponding channels 212, 216. Additionally, each key path openings 307, 407 must be aligned with the corresponding one of the visor and peak locks of the left and right mounting mechanisms. Once aligned, simply press down on the mounting sections 302, 402 to engage the flanges within the channels, simultaneously locking the engaging elements 224, 226 within the visor and/or peak grooves 308, 408. Finally, the visor 300 and peak 400 can each be moved, such as by rotation about a rotational axis passing through the push button, in the lowered position in a ready-to-use helmet configuration.

It should be appreciated from the present disclosure that the mounting system offers improvements and advantages as described above. Indeed, the mounting mechanisms 204 allowing customization of the helmet 100 and disengagement of both a helmet visor 300 and a helmet peak 400 simultaneously presents multiple advantages. Firstly, the key path locks combined with the engaging elements of the first slider 220 offer increased security for retaining the helmet accessories connected to the helmet 100. Additionally, the easy-to-use pushbutton 202 reduces operation time for disengaging the accessories, and as mentioned, allows for simultaneous disconnection. Finally, the mounting system 200 allows for high customizability of the helmet 100, allowing the wearer to connect any desired accessory, individually or in combination.

While the mounting system 200 has been described in conjunction with the exemplary embodiments described above, many equivalent modifications and variations will be apparent to those skilled in the art when given this disclosure. Accordingly, the exemplary embodiments set forth above are considered to be illustrative and not limiting. The scope of the claims should not be limited by the preferred embodiments set forth in this disclosure but should be given the broadest interpretation consistent with the description as a whole.

The invention claimed is:

1. A helmet comprising:—a helmet shell; —a mounting system laterally positioned on the helmet shell; —a visor removably and pivotally connected to the mounting system, the visor being movable between lowered and raised positions; and—a peak removably connected to the mounting system, the mounting system being operable to permit each of the visor and peak to be independently disengaged from the mounting system upon manual operation of the mounting system, wherein the mounting system comprises right and left mounting mechanisms positioned on right and left sides of the helmet shell, the right mounting mechanism including a right actuator and the left mounting mechanism including a left actuator, each of which is operable to disengage both the visor and the peak from respective right and left mounting mechanisms, wherein each mounting mechanism comprises:—a base positioned on corresponding right and left sides of the helmet shell, the base of each mounting mechanism comprising a corresponding one of the right and left actuators; and—a first slider operably connected to the base, the first slider being adapted to selectively engage the visor and the peak, and wherein operating the right and left actuators displaces the first sliders to disengage both the visor and the peak, thereby enabling disconnection of the visor and the peak from the mounting system.

2. The helmet according to claim 1, wherein the peak is pivotally connected to the mounting system, the peak being movable between lowered and raised positions.

3. The helmet according to claim 1, wherein the mounting system is operable to disengage both the visor and the peak simultaneously.

4. The helmet according to claim 1, wherein the visor comprises right and left visor mounting sections, and wherein each base comprises a visor channel adapted to receive one of said visor mounting sections.

5. The helmet according to claim 4, wherein each visor mounting section comprises a visor key path, and each base comprises a visor lock overhanging the visor channel, the visor lock being engageable with the visor key path to secure the visor to the mounting system.

6. The helmet according to claim 5, wherein the visor key path disengages from the visor lock upon positioning the visor in the raised position.

7. The helmet according to claim 4, wherein each visor mounting section comprises a visor groove, and wherein the first slider comprises a visor engaging element engageable within the visor groove, further securing the visor to the mounting system.

8. The helmet according to claim 7, wherein movement of the visor is blocked when the visor engaging element is engaged with the visor groove.

9. The helmet according to claim 7, wherein the peak comprises right and left peak mounting sections, and each base comprises a peak channel adapted to receive respective peak mounting sections.

10. The helmet according to claim 9, wherein each peak mounting section comprises a peak key path, and each base comprises a peak lock overhanging corresponding peak channels, the peak locks being engageable with corresponding peak key paths so as to secure the peak to the mounting system.

11. The helmet according to claim 10, wherein the peak key paths are disengaged from the peak locks upon positioning the peak in the raised position.

12. The helmet according to claim 9, wherein each peak mounting section comprises a peak groove, and the first slider comprises a peak engaging element engageable with the peak groove, further securing the peak to the mounting system.

13. The helmet according to claim 12, wherein the first slider is spring-loaded to bias at least one of the peak engaging element and the visor engaging element in an engaged position.

14. The helmet according to claim 12, wherein the right and left actuators and respective first sliders comprise complementary surfaces cooperating by having each first slider slide away from the respective actuator upon operation of the right and left actuators, thus disengaging the peak and/or visor engaging element.

15. The helmet according to claim 1, wherein each mounting mechanism further comprises a secondary slider having a secondary peak engaging element operably engageable with the peak, the secondary peak engaging element preventing rotation of the peak when engaged with the peak.

16. The helmet according to claim 15, wherein the secondary slider is spring-loaded to bias the secondary peak engaging element in an engaged position.

17. The helmet according to claim 15, wherein upon pivoting the peak between the lowered and raised positions, the secondary slider disengages the peak to allow movement of the peak.

18. The helmet according to claim 1, wherein each mounting mechanism further comprises a biasing element adapted to bias the visor and/or peak away from the helmet shell to facilitate removal of said visor and/or peak.

19. The helmet according to claim 1, wherein the actuators are pushbuttons or lever mechanisms.

* * * * *